United States Patent [19]

Anderson

[11] Patent Number: 4,815,969

[45] Date of Patent: Mar. 28, 1989

[54] HEAT LOSS REDUCTION IN ROTATING DRUM DRYERS

[76] Inventor: Russell W. Anderson, 183 Youngs Rd., Mahwah, N.J. 07430

[21] Appl. No.: 96,740

[22] Filed: Sep. 14, 1987

[51] Int. Cl.[4] ..... F27B 7/00

[52] U.S. Cl. ..... 432/103; 432/114; 432/116; 432/234

[58] Field of Search ..... 432/103, 105, 116, 236, 432/246, 234, 235

[56] References Cited

U.S. PATENT DOCUMENTS

| | | | |
|---|---|---|---|
| 2,749,107 | 6/1956 | Corriston | 432/234 |
| 3,008,701 | 11/1961 | Wiseman | 432/116 |
| 3,830,171 | 8/1974 | Rolli | 432/116 |
| 4,071,311 | 1/1978 | Errington | 432/234 |
| 4,170,451 | 10/1979 | Laff | 432/234 |
| 4,450,872 | 5/1984 | Orcutt | 432/234 |
| 4,522,587 | 6/1985 | Miller | 432/114 |
| 4,539,055 | 9/1985 | Orcutt | 432/234 |

*Primary Examiner*—Henry C. Yuen

*Attorney, Agent, or Firm*—Samuelson & Jacob

[57] ABSTRACT

A drum dryer for use in the manufacture of bituminous concrete asphalt is provided with a jacket including a layer of ceramic fiber insulation bonded to an outer sheath of aluminum, the jacket being wrapped around the outer peripheral surface of the wall of the drum and secured in place with bands of stainless steel strapping so as to reduce to a minimum heat loss due to dissipation of heat from the outer peripheral surface of the drum wall, thereby enabling conservation of energy, while affording protection to personnel and equipment in the vicinity of the dryer drum against excessive heat.

6 Claims, 1 Drawing Sheet

HEAT LOSS REDUCTION IN ROTATING DRUM DRYERS

Figure 1:
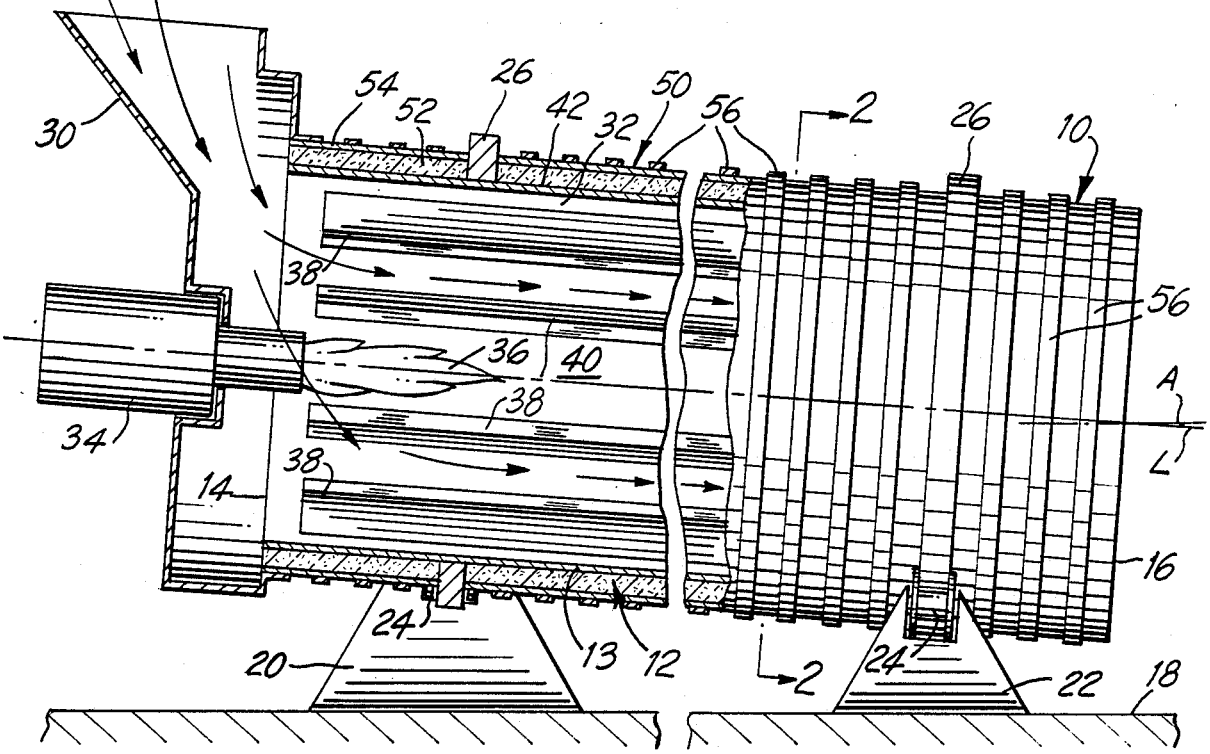

The present invention relates generally to the reduction of heat loss in a process for manufacturing bituminous concrete asphalt and pertains, more specifically, to an improvement in drum dryers used in such processes, wherein the drum of the drum dryer is insulated against heat loss.

In the manufacture of bituminous concrete asphalt, sand and stone which constitute the aggregate used in the process must be heated thoroughly to ensure that all unwanted moisture is removed from these materials before the introduction of hot liquid asphalt in the process. Any such moisture could lead to a violent reaction upon exposure to the heat of the hot asphalt, thereby causing instability and adversely affecting the process.

The most common apparatus currently in use for removing such unwanted moisture is the drum dryer. In essence, the drum dryer is a large cylindrical furnace which includes a steel drum mounted for rotation about an axis inclined at a slight angle to the horizontal. The drum generally is six to eight feet in diameter and is approximately twenty to thirty feet long. A large burner is placed at one end of the drum and directs a highly concentrated flame into the interior of the drum as the raw sand and stone materials are introduced adjacent that same end. As the drum rotates, the aggregate materials are tumbled within the interior of the drum and move slowly down the incline, through the interior of the drum, to the opposite end. As the aggregate materials are heated, primarily by contact with the heated surfaces of the drum wall, all unwanted moisture is driven off. Subsequently, the hot asphalt is introduced and mixed with the dried aggregate to complete the process.

Observation of the above-described process at various bituminous concrete asphalt production facilities revealed that the greatest amount of heat lost in the process is the dissipation of heat from the outer surfaces of the dryer drum. In view of the very high temperatures involved, the construction of the apparatus, and the adverse conditions under which the drum dryers are operated, insulation of the drum was thought to be impractical. Commonly available high temperature resistant insulating materials, such as fiberglass and isocyanurate sheathing, could not withstand the necessary extended contact with the high temperature surfaces of the drum and suffered breakdown and disintegration within a relatively short period of time.

The present invention provides an arrangement by which the drum of a drum dryer used in the manufacture of bituminous concrete asphalt is successfully insulated against excessive heat loss and exhibits several objects and advantages, some of which may be summarized as follows: Realization of a dramatic decrease in heat loss resulting from the dissipation of heat from the external, or outer, surfaces of the drum, thereby attaining improved concentration of heat within the drum for more effective drying; increased economy of manufacture as a result of reduced fuel consumption per ton of bituminous concrete asphalt produced; increased efficiency of operation as a result of a reduction in warm-up time upon start-up of a production run; reduced heat loss during idle periods, with concomitant savings in fuel consumption; elimination of excessive heat in the vicinity of the drum dryer for the protection of personnel and equipment in the surrounding areas; simplicity of design and construction for ready adaptation to existing facilities, as well as to new installations; protection of the outer surfaces of the drum against the elements of weather, thereby reducing surface oxidation and the need for extensive maintenance, such as painting and the like; enhanced appearance of the installation; and rugged construction for effective operation over a relatively long service life.

The above objects and advantages, as well as further objects and advantages, are accomplished by the present invention, which may be described briefly as providing, in a drum dryer for use in the manufacture of bituminous concrete asphalt, the drum dryer being of the type having a drum including a cylindrical drum wall of given length and diameter, the drum wall having an outer peripheral surface, and the drum being mounted for rotation about an axis of rotation tilted at a shallow angle to the horizontal, and a burner for directing heat into the drum, the improvement comprising: a jacket extending essentially completely around the outer peripheral surface of the drum wall along at least a substantial portion of the length of the drum wall, the jacket including an outer sheath of sheet material, and a layer of ceramic fiber insulation placed between the outer sheath and the outer peripheral surface of the drum wall; and securing means for securing the jacket to the drum wall during manufacture of the bituminous concrete asphalt.

Figure 2:
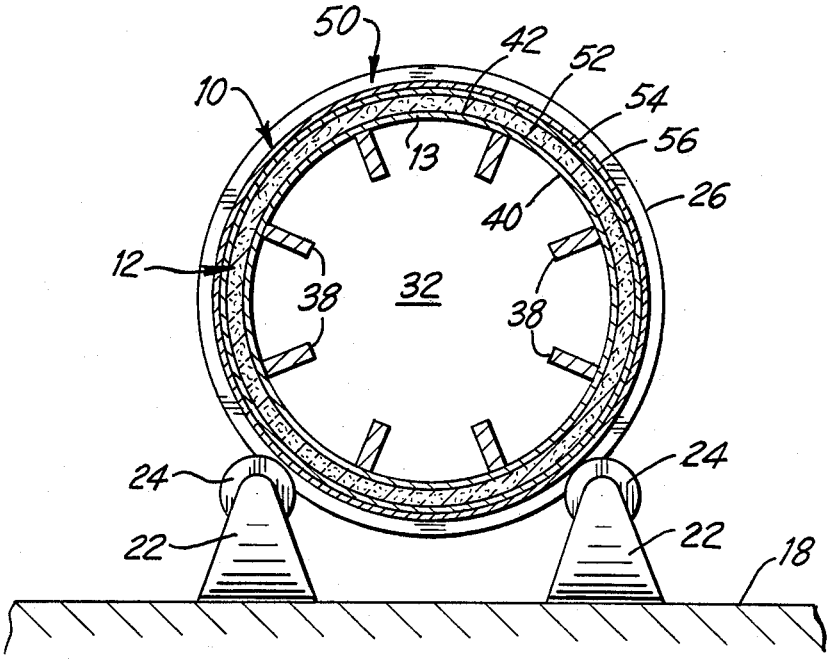

The invention will be understood more fully, while still further objects and advantages will become apparent, in the following detailed description of a preferred embodiment of the invention illustrated in the accompanying drawing, in which:

FIG. 1 is a somewhat diagrammatic, longitudinal cross-sectional view of a drum dryer constructed in accordance with the invention; and FIG. 2 is a transverse cross-sectional view taken along line 2—2 of FIG. 1.

Referring now to the drawing, a drum dryer 10 is constructed in accordance with the invention and is seen to include a drum 12 having an elongate cylindrical wall 13 extending along a longitudinal axis L between a first end 14 and a second end 16. Drum 12 is supported above ground 18 by a first support 20, located adjacent the first end 14, and a second support 22, located adjacent second end 16, and is mounted for rotation about axis L by roller assemblies 24 placed upon the supports 20 and 22 and making rolling engagement with corresponding circumferential tracks 26 carried by the drum 12. Support 20 is elevated above ground 18 slightly higher than support 22 so that axis L, and drum 12, is tilted at a shallow angle A to the horizontal, placing end 14 at a slightly higher elevation than end 16 of the drum 12.

In the process of manufacturing bituminous concrete asphalt, the sand and stone which make up the aggregate materials to be mixed with molten asphalt are introduced into the drum 12 at end 14 through an inlet chute 30 placed in communication with the interior 32 of drum 12 at end 14, as indicated by the arrows in FIG. 1. A burner 34 is located adjacent the end 14 and directs a highly concentrated flame 36 into the interior 32 of drum 12 to heat the interior 32. Drum 12 is rotated about axis L and the aggregate materials proceed downstream within the drum 12, in the direction from end 14 to end 16, preferably assisted by flights 38 affixed to the inner surface 40 of the wall 13 of the drum 12 and extending along the interior 32 of the drum 12. The heat generated by burner 34 heats the interior 32 of the drum 12 and the aggregate materials, as the materials proceed downstream, and drives moisture from the aggregate materials so that upon the introduction of molten asphalt for mixing with the aggregate materials adjacent the downstream end 16 of the drum 12, the dried aggregate materials will be mixed without deleterious reaction, all in manner now well known in the manufacture of bituminous concrete asphalt.

The wall 13 of drum 12 is constructed of steel and conducts heat readily. In conventional installations, the outer surface 42 of the wall 13 of drum 12 is exposed to the surrounding environment and heat is dissipated from the outer surface 42. The heat loss resulting from such dissipation of heat from the outer surface 42 of the drum 12 is costly, both from the standpoint of energy consumption and the need to protect personnel and equipment in the vicinity of the drum 12 from the effects of the heat emanating from the outer surface 42. In order to reduce such dissipation of heat, the present invention provides a jacket 50 which insulates the drum 12 against dissipation of heat from the outer surface 42. Jacket 50 extends essentially completely around the entire periphery of the wall 13 of drum 12, along at least a substantial portion of the length of the drum 12, and preferably along the entire length of the drum 12.

Jacket 50 includes a layer 52 of ceramic fiber insulation bonded to an outer sheath 54 of sheet metal, the sheet metal preferably being aluminum. It has been found that commonly available insulation, such as fiberglass or isocyanurate sheathing, will not withstand the temperatures and the conditions to which jacket 50 is exposed. However, the combination of ceramic fiber insulation and a sheath of sheet metal has been found to perform the desired function with reliability, as well as with effectiveness. The laminated structure of jacket 50 provides a blanket of insulation which effectively reduces to a minimum the dissipation of heat from the outer surface 42 of drum 12 which might otherwise occur by conduction, convection and radiation. Conduction and convection losses are effectively eliminated by the layer 52 of ceramic fiber insulation, while the sheath 54 reflects heat to essentially eliminate radiation losses. In addition, the sheath 54 provides rigidity and stability during both installation and use, and protects against weather and other conditions during service. The laminated structure of jacket 50 enables ease of installation, both in new construction and in the adaptation to an existing installation. Thus, jacket 50 is flexible in diametric directions and need merely be wrapped around the outer periphery of the wall 13 of drum 12 to conform the jacket 50 closely to the wall 13 of drum 12, and then is secured in place. In the illustrated embodiment, securing means are shown in the form of a plurality of bands 56 extending around the jacket 50 to secure the jacket in place. Bands 56 preferably are constructed of a tough, flexible material having the requisite strength and resistance to corrosion, such as stainless steel straps. Installation is accomplished, both in new construction and in an existing installation, without interference with the mechanism by which drum 12 is mounted for rotation about axis L.

In a typical installation in which the drum 12 has a diameter of eight feet and a length of thirty feet, the heat loss from the outer surface 42 due to radiation alone amounts to almost 1.6 million BTU per hour. A layer 52 of ceramic fiber insulation having a thickness of only about 1.5 inches bonded to an outer sheath 54 of aluminum having a thickness of about 0.030 inch is sufficient to essentially eliminate heat loss from the outer surface 42 due to radiation. Over eight hours of operation per day, such a reduction in heat loss results in the conservation of approximately fifteen to twenty-five percent of the normal fuel oil consumption during each day of operation. Thus, it can be seen that the relatively simple addition of jacket 50 results in a considerable saving of energy. Jacket 50 provides and economical arrangement which not only is effective in conserving energy, but is rugged enough to withstand the conditions encountered in the manufacture of bituminous concrete asphalt over a long service life. In addition, the outer surface 42 is protected against the elements of weather, thereby reducing surface oxidation and the need for extensive maintenance, such as painting and the like. Further, the jacket 50 provides an enhanced, aesthetically pleasing appearance to the installation.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a drum dryer for use in the manufacture of bituminous concrete asphalt, the drum dryer being of the type having a drum including a cylindrical drum wall of heat-conductive material, such as steel, having a given length and a relatively large diameter, the drum wall having an outer peripheral surface, and the drum being mounted for rotation about an axis of rotation tilted at a shallow angle to the horizontal, and a burner for directing heat into the drum, the improvement comprising:

a jacket extending essentially completely around the outer peripheral surface of the heat-conductive drum wall along at least a substantial portion of the length of the drum wall, the jacket being flexible in diametric directions so as to enable close conformance of the jacket to the outer peripheral surface of the drum wall, the jacket including an outer sheath of sheet metal and a layer of ceramic fiber insulation placed between the outer sheath and the outer peripheral surface of the drum wall, the layer of ceramic fiber insulation being bonded to the outer sheath so as to be integral therewith; and securing means for securing the jacket to the drum wall, the securing means including a plurality of metal bands spaced from one another along the length of the jacket, each band extending around the jacket to hold the jacket against the outer peripheral surface of the drum wall during manufacture of the bituminous concrete asphalt.

2. The invention of claim 1 wherein the metal bands of the securing means each include a strap of stainless steel.

3. The invention of claim 1 wherein the layer of ceramic fiber insulation has a thickness of about 1.5 inches.

4. The invention of claim 1 wherein the metal of the outer sheath is aluminum.

5. The invention of claim 4 wherein the aluminum outer sheath has a thickness of about 0.030 inch.

6. The invention of claim 5 wherein the layer of ceramic fiber insulation has a thickness of about 1.5 inches.

* * * * *